US008833020B2

(12) United States Patent
Oliver et al.

(10) Patent No.: US 8,833,020 B2
(45) Date of Patent: Sep. 16, 2014

(54) THERMAL ISOLATOR GROUND PAN FOR FOUNDATION OF MANUFACTURED BUILDING

(76) Inventors: Scott Oliver, Linden, TN (US); James Oliver, Linden, TN (US)

( * ) Notice: Subject to any disclaimer, the term of this patent is extended or adjusted under 35 U.S.C. 154(b) by 0 days.

(21) Appl. No.: 12/777,038

(22) Filed: May 10, 2010

(65) Prior Publication Data

US 2010/0307073 A1 Dec. 9, 2010

Related U.S. Application Data

(60) Provisional application No. 61/177,103, filed on May 11, 2009.

(51) Int. Cl.

| | |
|---|---|
| ***E02D 31/14*** | (2006.01) |
| ***E02D 27/02*** | (2006.01) |
| ***E04B 1/343*** | (2006.01) |

(52) U.S. Cl.

CPC ..... *E02D 31/14* (2013.01); *E02D 27/02* (2013.01); *E04B 1/34352* (2013.01); *E02D 2300/0046* (2013.01); *Y10S 52/11* (2013.01)

USPC ..... 52/292; 52/155; 52/169.11; 52/309.4; 52/DIG. 11; 52/169.9

(58) Field of Classification Search

CPC ..... E04B 1/34352; E02D 27/42; E02D 27/35; E02D 27/02; E02D 31/14; E02D 2300/0046

USPC ..... 52/292, 155, 167.7, 167.8, 167.9, 52/169.9, 741.15, 169.11, 309.4, DIG. 11; 248/156

See application file for complete search history.

(56) References Cited

U.S. PATENT DOCUMENTS

| | | | | | |
|---|---|---|---|---|---|
| 3,353,852 | A | * | 11/1967 | Wood | 403/189 |
| 3,380,205 | A | * | 4/1968 | Ratchford | 52/126.7 |
| 4,189,125 | A | * | 2/1980 | Little | 248/346.02 |
| 4,348,843 | A | * | 9/1982 | Cairns et al. | 52/167.1 |
| 4,512,120 | A | * | 4/1985 | Lindal | 52/79.1 |
| 4,899,497 | A | * | 2/1990 | Madl, Jr. | 52/126.6 |
| 5,067,289 | A | * | 11/1991 | Ouderkirk et al. | 52/169.11 |
| 5,419,524 | A | * | 5/1995 | Evans et al. | 248/346.4 |
| 5,487,534 | A | * | 1/1996 | Sakamoto et al. | 267/141.1 |

(Continued)

FOREIGN PATENT DOCUMENTS

| | | | | | |
|---|---|---|---|---|---|
| DE | 19834060 | A1 | * | 4/1999 | E01B 37/00 |
| EP | 2363535 | A1 | * | 9/2011 | E02D 27/02 |

OTHER PUBLICATIONS

Dictionary.com, definition of "on", <http://dictionary.reference.com/browse/on?s=t&Id=1089>.*

(Continued)

*Primary Examiner* — Brent W Herring
(74) *Attorney, Agent, or Firm* — Baker Donelson

(57) ABSTRACT

A foundation system for supporting a manufactured building having a support beam, comprising a ground pan having a planar surface received on a ground surface and a thermally insulative member disposed on the ground pan, which cooperatively define in situ a proximate thermally isolated ground column, with a foundation support connected to the ground pan and to the support beam, the thermally insulative member restricts communication of heat from the proximate thermally isolated ground column below the ground pan for resisting frost heaving. A method of resisting frost heave of a foundation is disclosed.

4 Claims, 4 Drawing Sheets

(56) References Cited

U.S. PATENT DOCUMENTS

| | | | | |
|---|---|---|---|---|
| 5,664,394 | A * | 9/1997 | Sweeney | 52/782.1 |
| 5,697,191 | A * | 12/1997 | MacKarvich | 52/169.9 |
| 5,921,035 | A * | 7/1999 | Kempf | 52/157 |
| 6,119,412 | A * | 9/2000 | Jackson | 52/143 |
| 6,298,611 | B1 | 10/2001 | Oliver et al. | |
| 6,505,447 | B1 | 1/2003 | Oliver et al. | |
| 6,634,150 | B1 | 10/2003 | Oliver et al. | |
| 6,718,711 | B1 * | 4/2004 | Gilman | 52/299 |
| 7,140,157 | B2 | 11/2006 | Oliver et al. | |
| 7,313,892 | B1 * | 1/2008 | Oliver et al. | 52/309.1 |
| 7,526,899 | B1 * | 5/2009 | Oliver et al. | 52/292 |
| 7,874,767 | B2 * | 1/2011 | Jones et al. | 405/302.7 |
| 8,070,395 | B2 * | 12/2011 | Jones et al. | 405/302.7 |
| 2005/0011149 | A1 * | 1/2005 | Mard | 52/292 |
| 2005/0081459 | A1 * | 4/2005 | Moroschan | 52/169.1 |
| 2011/0036025 | A1 * | 2/2011 | Boulay | 52/157 |

OTHER PUBLICATIONS

Cover page of set of documents for OTI foundation & anchor systems, each document is listed in this IDS separately, Oliver Technologies, Inc. 467 Swan Ave., Hohenwald, TN 38462; Dec. 4, 2002.

Oliver Technologies, Inc.; Installation Instructions Galvanized Strapping, p. 9; 467 Swan Ave., Hohenwald, TN 38462; Jun. 2004.

Oliver Technologies, Inc.; Ground Anchor Installation Instructions, p. 9; 467 Swan Ave., Hohenwald, TN 38462; Nov. 2002.

Oliver Technologies, Inc., Installation Instructions OTI Auger Anchor, p. 10; 467 Swan Ave., Hohenwald, TN 38462; Nov. 2002.

Oliver Technologies, Inc, "Quick Anchor Installation Instructions Model #OTCAP1, OTI Anchor Model#'s OT3044BP and OT3646BP", p. 11; 467 Swan Ave., Hohenwald, TN 38462; Nov. 2002.

Oliver Technologies, Inc., "Ground Anchor Installation Instructions", p. 12; 467 Swan Ave., Hohenwald, TN 38462; Nov. 2002.

Oliver Technologies, Inc., "Longitudinal Frame Connections OTQC", p. 13; 467 Swan Ave., Hohenwald, TN 38462; Nov. 2002.

Oliver Technologies, Inc., "I-Beam Frame Connections Swivel Connector (Part# 2001)", p. 14; 476 Swan Ave., Hohenwald, TN 38462; Nov. 2002.

Oliver Technologies, Inc.; Manufactured Housing Foundation Systems, A Division of Oliver Technologies, Inc.; Swivel Frame Tie, 467 Swan Ave., Hohenwald, TN 38462; Dec. 4, 2002.

Oliver Technologies, Inc.; Installation Instructions, Model #OTLT, Longitudinal Beam Connector, 467 Swan Ave., Hohenwald, TN 38462; Aug. 13, 2003.

Oliver Technologies, Inc.; Installation Instructions Galvanized Strapping, p. 15; 467 Swan Ave., Hohenwald, TN 38462; Nov. 2002.

Oliver Technologies, Inc.; Wind Zone Map, p. 16; 467 Swan Ave., Hohenwald, TN 38462; Nov. 2002.

Oliver Technologies, Inc.; Specifications, Oliver Technologies, Inc.—Adjustable Outrigger, p. 25; 467 Swan Ave., Hohenwald, TN 38462; Nov. 2002.

Oliver Technologies, Inc.; Specifications, Oliver Technologies, Inc.—Anchors and Components; pp. 26-28; 467 Swan Ave., Hohenwald, TN 38462; Nov. 2002.

Paul W. Hayman, et al., An Alternative Shallow Frost Protected HUD Compliant Foundation Design for Manufactured Homes, Dec. 1, 2009, pp. 1-9, appendix 5 pgs., Hayman Engineering, LLC.

Paul W. Hayman, MS, PE, A Frost Free Foundation (FFF): an Alternative Shallow Frost Protected Foundation Design for Manufactured Homes, Apr. 1, 2010, pp. 1-11, Hayman Engineering, LLC.

U.S. Department of Housing and Urban Development, Memorandum from Elizabeth A. Cocke, Deputy Administrator, Office of Manufactured Housing Programs, Comments on Recent Publications on Frost Free Foundation Design, Apr. 20, 2010, pp. 1-2, Washington, DC, www.hud.gov.

* cited by examiner

THERMAL ISOLATOR GROUND PAN FOR FOUNDATION OF MANUFACTURED BUILDING

The present application claims the benefit of U.S. Provisional Patent Application Ser. No. 61/177,103, filed May 11, 2009.

TECHNICAL FIELD

The present invention relates to foundations for manufactured buildings. More particularly, the present invention relates to a ground pan that reduces frost heaving occurrences to foundations of manufactured buildings.

BACKGROUND OF THE INVENTION

Manufactured buildings, such as manufactured or mobile homes and offices, are manufactured remote from an instillation site and moved on wheels to the installation site. The manufactured building typically includes long, longitudinal support beams underneath the building to support the floor of the building. During typical installation, a plurality of piers placed between a ground pan and the support beam support the building level on the site. Installed manufactured buildings also are connected to foundation systems to resist lateral and longitudinally wind forces on the building. These foundation systems use a ground pan and an elongated strut connected at a lower end to the ground pan and at the upper end to a support beam of the manufactured building. The elongated strut can be oriented parallel to a longitudinal axis of the support beam or extend laterally from underneath one support beam to connect to the adjacent support beam of the manufactured buildings. Such foundations provide resistance to wind forces in both the lateral and longitudinal directions.

While these foundation assemblies have been successful in resisting wind loads on installed manufactured buildings, there are drawbacks to usage of these foundations in regions of the country in which the ground experiences frost heave. Heave in soil occurs when the water in the ground freezes. The freezing water expands, and causes the ground to heave up or rise up or swell. Frost heave causes the foundation ground pans (or pads) to move. This movement is communicated to the house through the enlongated struts between the ground pan and the support beam, and may contribute to the house becoming out of level. A building that is not level can result in openings in the building becoming out of skew. This causes doors to become skewed and not open or close properly such as in doorways and cabinetry. Windows likewise become difficult to open and close.

It is believed that there are three factors that contribute to frost heave. These factors are the soil being sufficiently saturated with water, the atmospheric temperature, and the duration of the saturation and cold temperatures. Efforts to resist frost heave have been made. Typically in areas that experience significant frost heave, the foundation must be engineered and extend below the frost line. This requires excavation of an in-ground footing and installation of a rigid or engineered foundation such as concrete footers and pilings. In other areas, skirting attaches around the perimeter of the manufactured home. The skirting extends from a lower edge of the manufactured home to the ground. The skirting encloses the space between the ground and the bottom of the manufactured home. The skirting also prevents flow of air under the home. Skirting used on the perimeter of manufactured buildings placed at sites with pier supports is not entirely successful in reducing or eliminating frost heave.

Even with skirting, manufactured buildings placed at sites with pier supports and not engineered foundations, are susceptible to frost heave of the ground below the ground pan.

Accordingly, there is a need for an improved ground pan to support piers and foundation of manufactured buildings while resisting frost heave. It is to such that the present invention is directed.

BRIEF SUMMARY OF THE INVENTION

The present invention meets the need in the art by providing a foundation system for supporting a manufactured building having a support beam, comprising a ground pan having a planar surface received on a ground surface and a thermally insulative cap disposed on the ground pan, whereby the ground pan and thermally insulative cap define in situ a proximate thermally isolated ground column thereunder, with a pier positioned on the ground pan and extending into contact with the support beam for vertically supporting the support beam and transferring the mass of the manufactured home to the ground pan, whereby the thermally insulative cap restricts communication of heat from the proximate thermally isolated ground column for resisting frost heave.

In another aspect, the present invention provides a method of resisting frost heave of a foundation system that supports a manufactured building having a support beam, comprising the steps of:

(a) installing a ground pan on a ground surface;

(b) disposing a thermally insulative member on the ground pan;

(c) connecting a foundation support system to the ground pan and to a support beam of a manufactured building, whereby the ground pan and thermally insulative member define in situ a proximate thermally isolated ground column thereunder, which thermally insulative member restricts communication of heat from the proximate thermally isolated ground column for resisting frost heaving.

Objects, advantages, and features of the present invention will be apparent upon a reading of the detailed description together with observing the drawings and reading the appended claims.

DETAILED DESCRIPTION

Figure 1:
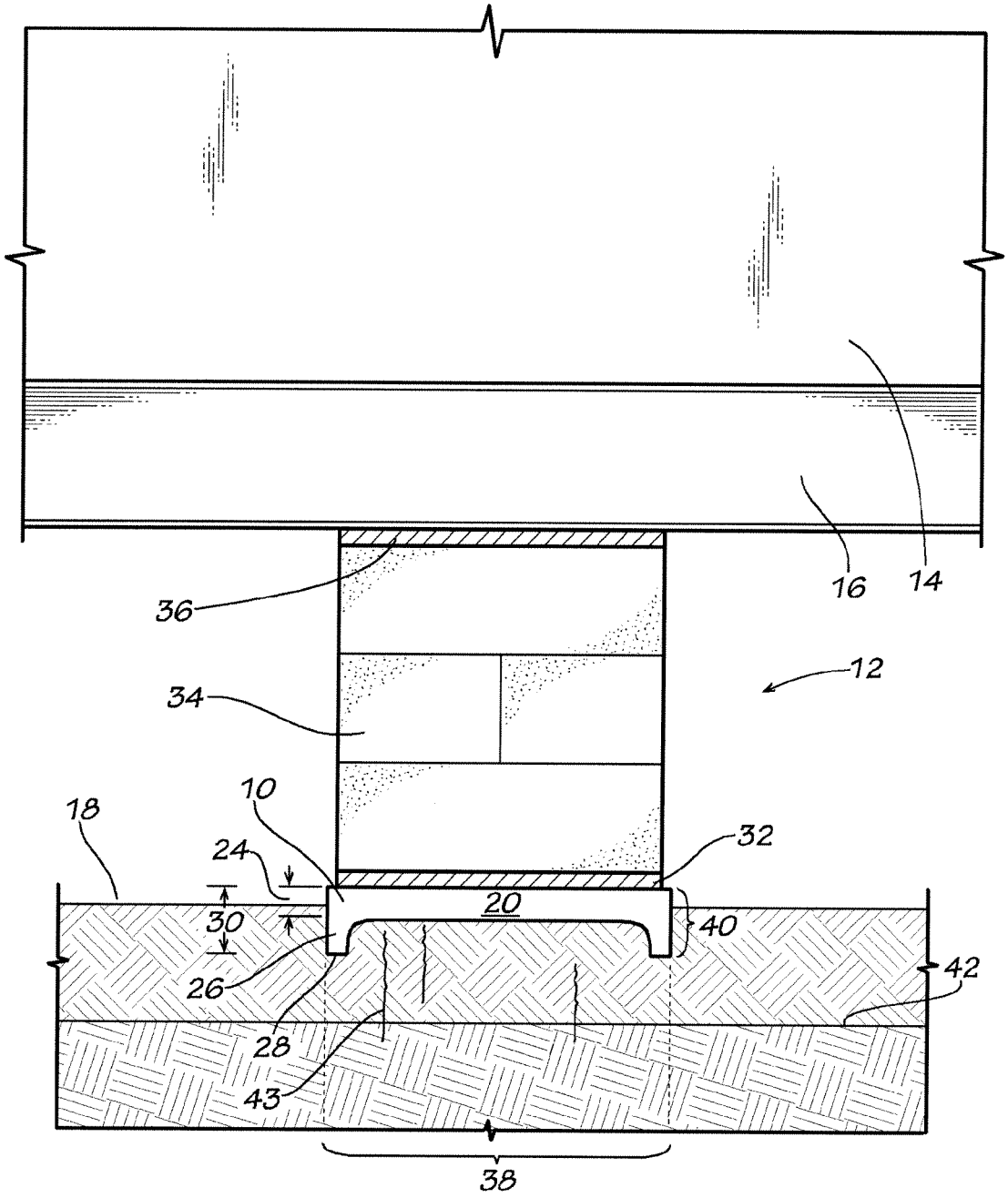
FIG. 1 is a perspective view of a manufactured building and support foundation with a thermal isolator ground pan in accordance with the present invention.

With reference to the drawings, in which like elements have like identifiers, the present invention provides a thermal isolator ground pan 10 for use with a foundation generally 12 of a manufactured buildings 14. Manufactured buildings have at least one longitudinally extended support beam 16, and typically two, or more, such support beams. The ground pan 10 seats on the ground generally 18. The ground pan 10 interacts with the ground 18 for resisting movement. Typically, this is accomplished by providing ground blades 20 that extend in a first direction substantially perpendicularly from a top surface of the ground pan. For example, opposing side edges of the ground pan 10 fold over to define a pair of opposing ground blades 20 that extend a first distance 24 from the top surface. In the illustrated embodiment, the ground pan 10 is formed from a metal sheet. The ground pan 10 includes ground blades that extend from a perimeter of the ground pan and includes a plurality of legs 26, with each leg extending from adjacent ground blades at intersections thereof. The legs 26 extend to a distal extent 28 that is a second distance 30 from the top surface, with the second distance 30 greater than the first distance 24.

The ground pan 10 includes a thermally insulative member 32. In the illustrated embodiment, the thermally insulative member 32 is a sheet that sits on the top surface of the ground pan 10 that spaces or separates the sheet from contact with the ground surface such as that below the ground pan, and can be attached such as with an adhesive. The thermally insulative sheet 32 is a foam sheet such as a STYROFOAM panel or sheet. In an alternate embodiment, the thermally insulative sheet 32 is defined by a spray-on thermal material. The spray-on thermal material sticks or attaches to the ground pan. In an alternate embodiment, the thermally insulative sheet (or spray-on material) seats inwardly on a bottom surface of the ground pan. The sheet 32 provides a thermally insulative layer or coating of between about ¼ inch to ½ inch, or other thickness suitable for restricting thermal communication, as discussed below.

A pier 34 positioned on the ground pan 10 extends between the ground pan and the support beam 16 for vertically supporting the support beam and for transferring the mass of the manufactured home to the ground pan. The pier in the illustrated embodiment comprises a stack of concrete blocks but can be a wood beam or other suitable load bearing material. The pier 34 can sit on the thermal sheet 32, or in a pocket or opening (see 71 in FIG. 3) defined in the thermal sheet so that the pier sits directly on the ground pan 10.

In the illustrated embodiment, a wood pad 36 seats between an upper surface of the pier 34 and the lower flange of the support beam 16. Conventionally, the wood pad 36 can be tapered for wedging between the pier 34 and the support beam 16.

The ground pan 10 and the thermally insulative sheet 32 cooperatively define in situ a substantially axially aligned ground column generally 38 with a thermally isolated ground column 40 proximate the ground pan 10. The ground column 38 below a frost line generally 42 communicates (generally 43) ground heat into the proximate thermally isolated ground column 40.

With reference to FIG. 1, the foundation 12 according to the present invention reduces movement of the ground pan 10 caused by frost heave arising from the freezing and thawing of moisture-laden ground engaged by the ground pan. The ground heat communicates 43 through the ground column 38 and into the proximate thermally isolated ground column 40. The thermally insulative sheet 32 aligned with the thermally isolative ground pan 10 caps the ground column 38 and restricts heat communication from the proximate thermally isolated ground column 40 to and through the ground pan 10 to the atmosphere. The proximate thermally isolated ground column 40 retains ground heat, and the proximate ground column experiences reduced freezing occurrences (compared to nearby portions of the proximate ground between the ground surface and the portion of the ground below the frost line 42). As a consequence, the occurrence of frost heave is reduced relative to the proximate thermally isolated ground column 40, and movement of the ground pan 10 is thereby reduced. The thermally insulative sheet 32 provides a high resistance to heat communication generally referred to in the insulating trade as an R factor, compared to the R factor of the ground pan alone.

Figure 2:
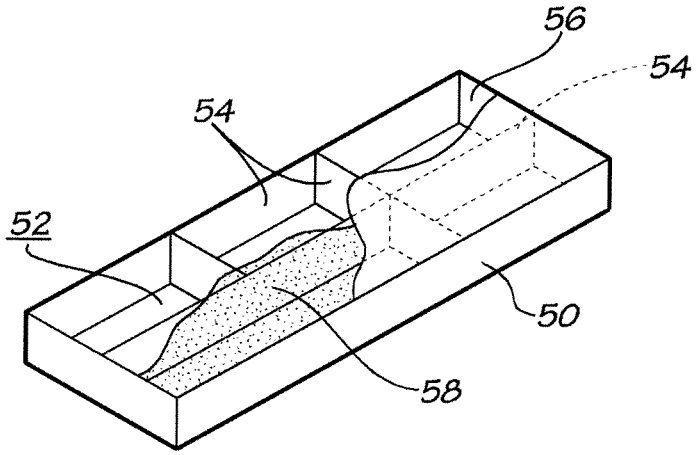
FIG. 2 is a detailed perspective view of an alternate embodiment of the thermal isolator ground pan according to the present invention.

FIG. 2 illustrates in perspective view an alternate embodiment of a ground pan 50 in accordance with the present invention. The ground pan 50 is molded from a plastic material and defines a floor 52 with a plurality of upstanding walls 54 that define chambers generally 56. The chambers 56 are filled with a conventional fluidal foam that cures to define an insulative sheet 58. In an alternate embodiment, the chambers 56 are covered with a firm thermally insulative sheet or panel. The ground pan 50 is gainfully used with a foundation for a manufactured home, as discussed above. The ground pan 50 and the thermally insulative sheet 58 cooperatively define in situ the ground column 38 and proximate thermally isolated ground column 40 relative to the ground pan 50 and the frost line 42. The thermally insulative sheet 58 caps the ground pan 50 and restricts heat communication from the ground column 38, and thus reduces occurrences of freezing of the proximate thermally isolated ground column 40.

It is to be appreciated that the thermally isolative ground pan 10 finds gainful use in an alternate embodiment in which the pier or the foundation supports are elongated steel members extending between the ground pan and the support beam. For example the foundation can include or use lateral elongated members and/or longitudinal elongated members (relative to a longitudinal axis of the support beam 16). For example, U.S. Pat. No. 6,634,150 discloses a foundation for manufactured homes that uses a lateral brace having a bottom end pivotably supported by the ground pan and a upper end pivotably attached to a beam connector adapted for clamping attachment to a lateral flange of a second support beam lateral of the first support beam. U.S. Pat. No. 7,140,157 discloses a foundation system for a manufactured building for preventing longitudinal movement.

Figure 3:
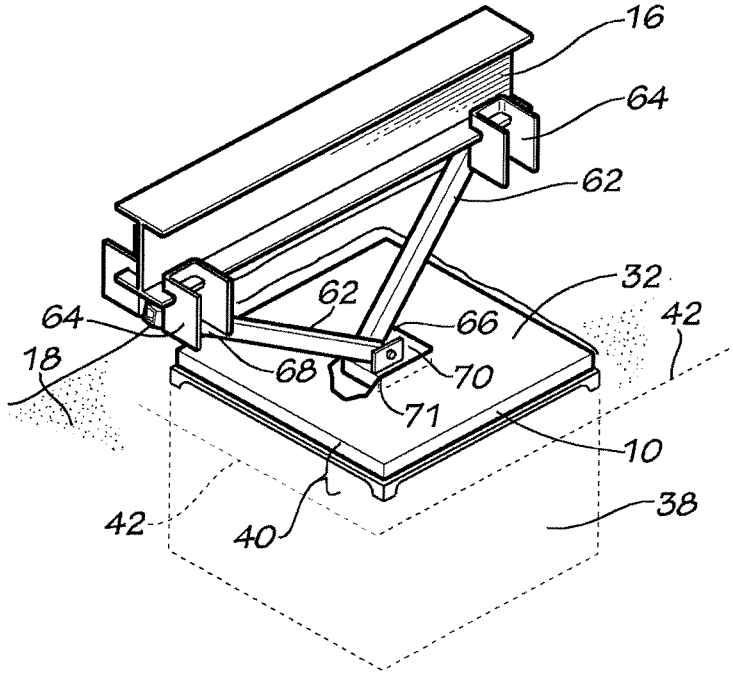
FIG. 3 is a perspective view of a foundation providing longitudinal support for a manufactured building with the thermal isolator ground pan illustrated in FIG. 1.

With reference now to the drawings, FIG. 3 illustrates in perspective view of an exemplary embodiment of a foundation system 60 according to U.S. Pat. No. 7,140,157, in which the thermally isolative sheet 32 seats on the ground pan 10. The foundation system 60 includes a pair of rigid arms 62 and means, such as a pair of clamps 64 for attaching an upper end of the arm to the support beam 16. Each arm 62 has a lower end 66 and an upper end 68. Each lower end 66 and upper end 68 includes a bore for receiving a fastener, for pivotable support of the lower end to a connector 70 (such as a U-shaped bracket) attached to the ground pan and for pivotable attaching of the upper end 68 to the beam connector 64 connected to the beam 16. The arms 62 may be of any suitably strong material, such as of one and one-half inch square steel tube. The ground pan 10 restricts downward and horizontal movement of the lower ends 66 of arms 62 and retains the lower ends in a fixed, but pivotable, position. In an alternate embodiment, the arms 62 are telescoping for selective length.

During use of the foundation system 60, the arms 62 communicate loading and wind forces to the ground pan 10, while the ground pan and the thermally insulative sheet 32 cooperatively define in situ the ground column 38 and the proximate thermally isolated ground column 40 relative to the ground pan 40 and the frost line 42. The thermally insulative sheet 32 caps the ground pan 10 and restricts heat communication from the ground column 38, and thus reduces occurrences of freezing of the proximate thermally isolated ground column 40. It is to be appreciated that an alternate embodiment can have a single arm 62 (not illustrated) connected to a load bearing ground pan 40 using a pier, and gainfully use the termally insulative sheet 32.

Figure 4:
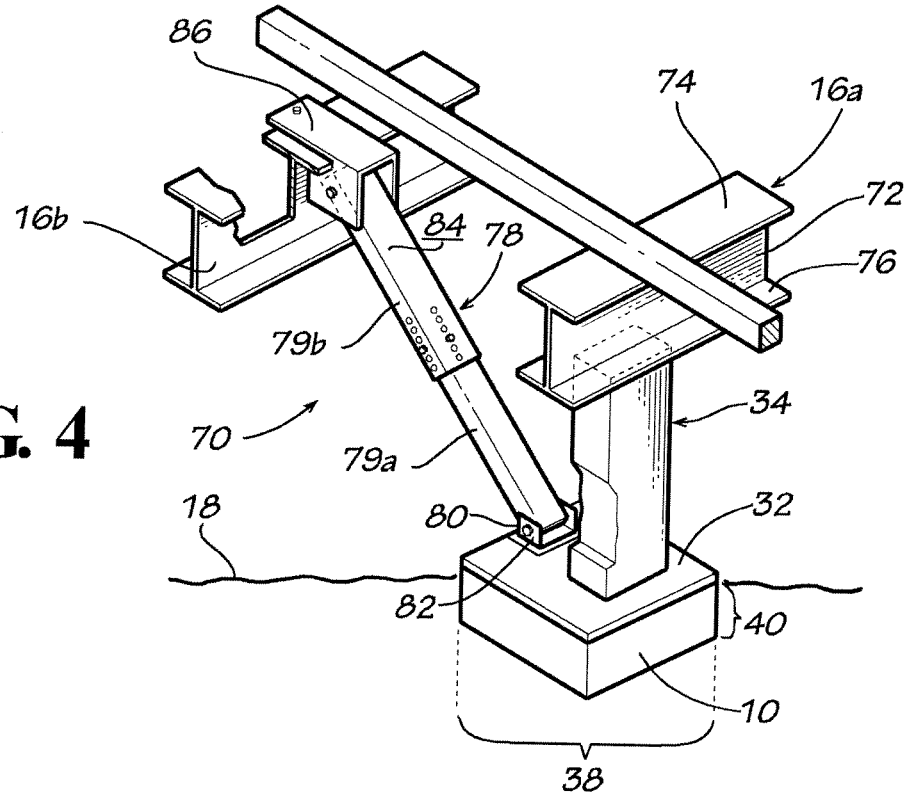
FIG. 4 is a perspective view of a foundation providing lateral support for a manufactured building with the thermal isolator ground pan illustrated in FIG. 1.

FIG. 4 illustrates in perspective view a foundation 70 providing lateral wind resistance in accordance with a foundation of a type disclosed in U.S. Pat. No. 6,634,150, and further with the thermally isolative sheet 32. The manufactured building 14 includes a pair of spaced-apart support beams 16*a* and 16*b*, such as a typical I-beam having a vertical web 72 and opposing upper and lateral flanges 74, 76. The ground pan 10 is disposed under a first of the support beams 16*a* with the insulative sheet 32. The pier 34 extends upwardly to contacting engagement with the support beam 16*a*. A lateral brace assembly 78 such as elongated struts or telescoping metal tubes 79*a*, 79*b* pivotably attaches at a lower end 80 to a connector 82 attached to the ground pan 10. An upper end 84 pivotably attaches to a beam connecter 86 attached to the second support beam 16*b*. A fastener such as a bolt connects the telescoping tubes together.

During use of the foundation system 70, the elongated struts 79 in the lateral brace assembly communicate loading and wind forces to the ground pan 10, while the ground pan 10 and the thermally insulative sheet 32 cooperatively define in situ the ground column 38 and the proximate thermally isolated ground column 40 relative to the ground pan 10 and the frost line 42. The thermally insulative sheet 32 caps the ground pan 10 and restricts heat communication from the ground column 38, and thus reduces occurrences of freezing of the proximate thermally isolated ground column 40.

It is to be appreciated that a foundation may readily provide both lateral and longitudinal load resistance by using a longitudinal strut or arm 62 as illustrated in FIG. 3 together with a lateral strut assembly 78 as illustrated in FIG. 4, while providing with the thermal sheet 32 reduced occurrences of frost heave movement of the foundation.

Figure 5:
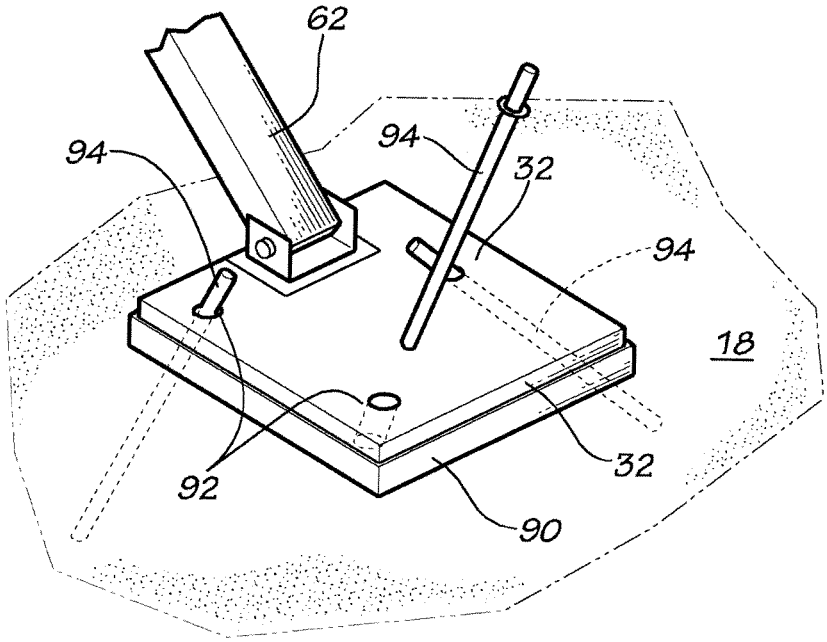
FIG. 5 is a detailed perspective view of an alternate embodiment of a thermal isolator foundation plate.

FIG. 5 illustrates in a detailed perspective view an alternate embodiment of a thermal isolator foundation plate 90 using the thermally insulative sheet 32. The foundation plate 90 includes openings 92 for receiving stakes 94 to secure the plate to the ground 18.

Figure 6:
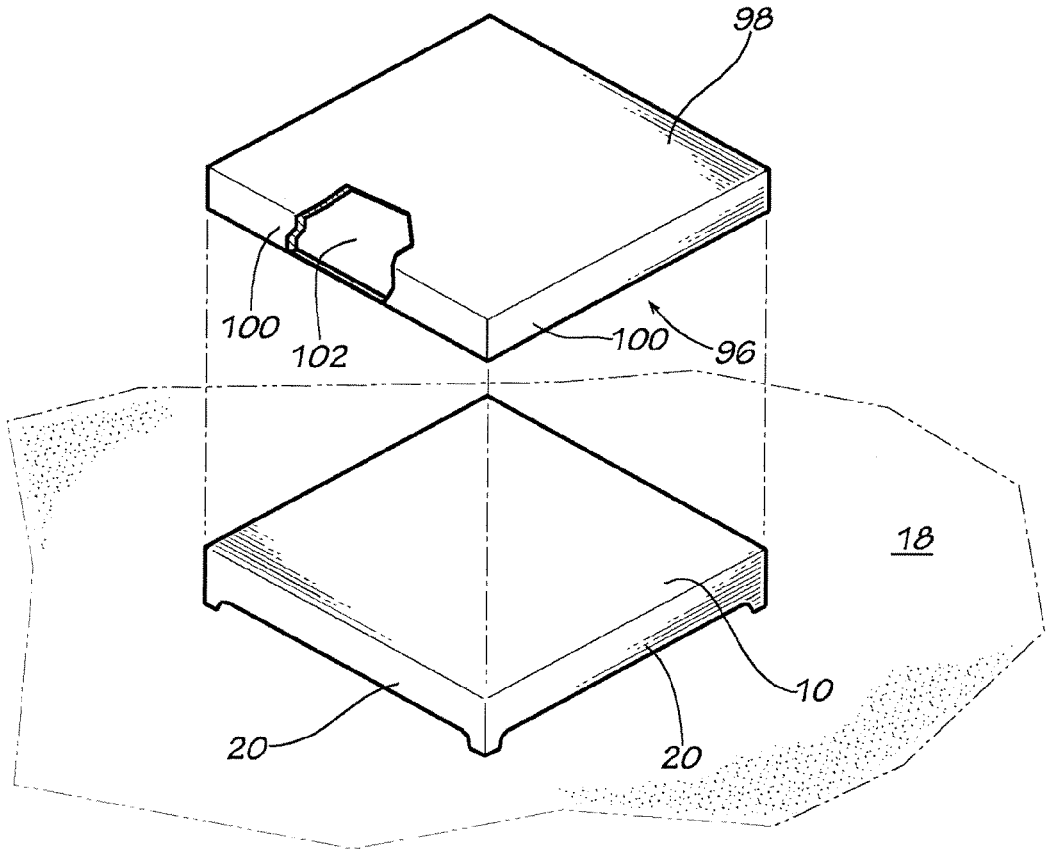
FIG. 6 is a detailed perspective view of a ground pan with an alternate embodiment of a thermal isolator plate in accordance with the present invention.

FIG. 6 illustrates a detailed perspective view of the ground pan 10 with an alternate embodiment in which the thermally isolative member is a cap 96 in accordance with the present invention. In this embodiment, the thermally insulative cap 96 (depicted in cut-away view) has a planar sheet 98 and side walls 100 extending in a first direction substantially normal from perimeter edges. This defines an interior cavity 102 for receiving the ground pan 10 while the side walls 10 align contactingly with the walls 20 of the ground pan. The walls 100 may in alternate embodiments taper outwardly relative to a perimeter edge of the sheet 98.

As with the embodiments discussed above and also with reference to FIG. 1, the thermally insulative sheet 32 (FIG. 5) and the thermally insulative cap 96 (FIG. 6) form in situ the ground column 38 and the proximate thermally isolated ground column 40 relative to the ground plate 90 or ground pan 10 and the frost line 42. The thermally insulative sheet 32 caps the ground plate 90 or ground pan 10 and restricts heat communication from the ground column 38, and thus reduces occurrences of freezing of the proximate thermally isolated ground column 40.

While the present invention is applied with disclosed foundations having ground pans, it is to be appreciated that the thermal insulative member can readily be used with other anchoring members such as helical shafts or anchors that connect to support beams of the manufactured building for resisting loads.

The present invention accordingly provides the foundation for manufactured buildings with the ground pan to cooperatively with the thermally insulative sheet for defining the proximate thermally isolated ground column to cap communication of ground heat therefrom and thereby resist frost heave occurrences. While this invention has been described in detail with particular references to illustrated embodiments thereof, it should be understood that many modifications, additions and deletions, in additions to those expressly recited, may be made thereto without departure from the spirit and scope of the invention.

What is claimed is:

1. A foundation system for supporting a manufactured building having a support beam, consisting of:

a rigid ground pan having a planar surface received on a ground surface and ground blades that extend from a perimeter of the ground pan in first direction substantially perpendicularly to a top surface to a distal extent that is a first distance from the top surface for driven insertion into the ground, and a plurality of legs, each leg extending from adjacent ground blades at intersections thereof, the leg extending to a distal extent that is a second distance from the top surface, the second distance greater than the first distance;

a thermally insulative foam member disposed on the top surface of the ground pan separated thereby from contact with the ground surface, whereby the ground pan and thermally insulative foam member define in situ a proximate thermally isolated ground column in the ground below the ground pan; and a pier positioned on the ground pan and extending into contact with a wood pad bearing against the support beam for vertically supporting the support beam and transferring the mass of the manufactured home to the ground pan, whereby the thermally insulative foam member restricts communication of heat from the proximate thermally isolated ground column for resisting frost heaving.

2. The foundation system as recited in claim 1, wherein the thermally insulative foam member is defined by a planar sheet of an insulating material.

3. The foundation system as recited in claim 1, wherein the rigid ground pan is metallic.

4. The foundation system as recited in claim 1, wherein the rigid ground pan is plastic.

* * * * *